United States Patent [19]

Deutsch et al.

[11] Patent Number: 5,054,461

[45] Date of Patent: Oct. 8, 1991

[54] IONIZATION CONTROL FOR AUTOMOTIVE IGNITION SYSTEM

[75] Inventors: Robert W. Deutsch, Sugar Grove; Koushun Sun, Hoffman Estates, both of Ill.

[73] Assignee: Motorola, Inc., Schaumburg, Ill.

[21] Appl. No.: 636,351

[22] Filed: Dec. 31, 1990

[51] Int. Cl.[5] ..... F02P 3/45

[52] U.S. Cl. ..... 123/609; 123/643

[58] Field of Search ..... 123/416, 417, 425, 606, 123/609, 620, 643; 73/35

[56] References Cited

U.S. PATENT DOCUMENTS

| | | | |
|---|---|---|---|
| 4,018,202 | 4/1977 | Gartner | 123/609 |
| 4,047,513 | 9/1977 | Adams et al. | 123/609 |
| 4,257,373 | 3/1981 | McDougal et al. | 123/424 |
| 4,265,211 | 5/1981 | Meloeny | 123/609 X |
| 4,377,140 | 3/1983 | Latsch | 123/425 X |
| 4,479,479 | 10/1984 | Dömland et al. | 123/630 |
| 4,631,451 | 12/1986 | Anderson et al. | 123/620 X |
| 4,886,029 | 12/1989 | Lill et al. | 123/479 |
| 4,913,123 | 4/1990 | DeBiasi et al. | 123/609 |
| 4,936,277 | 6/1990 | Deutsch et al. | 123/436 |

*Primary Examiner*—Willis R. Wolfe
*Attorney, Agent, or Firm*—John H. Moore

[57] ABSTRACT

A method and apparatus is disclosed for controlling the duration of ionization of spark plugs in an internal combustion engine. Generally, the ionization times of the spark plugs are individually measured and compared against a reference ionization time to develop an error signal representing an undesired deviation from the reference ionization time. Then, the duration of current dwell time in the engine's ignition coil is adjusted so as to change ionization time and reduce the size of the error signal.

27 Claims, 5 Drawing Sheets

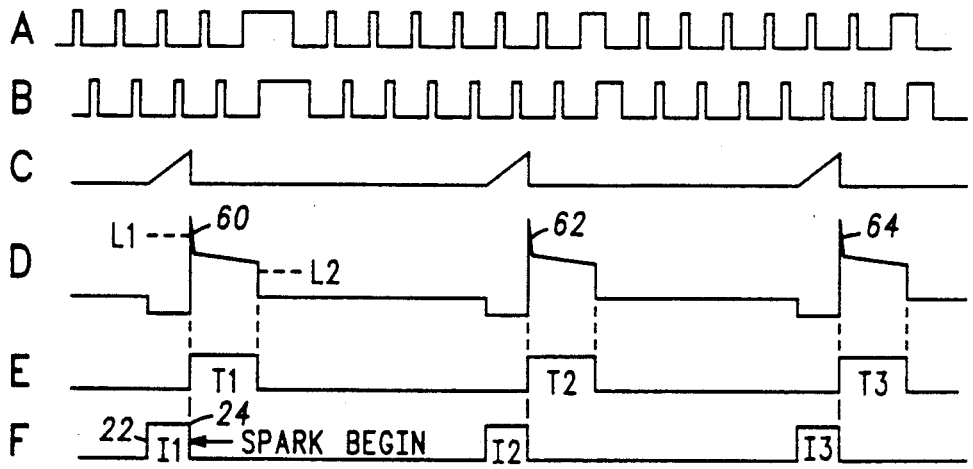
FIG. 4
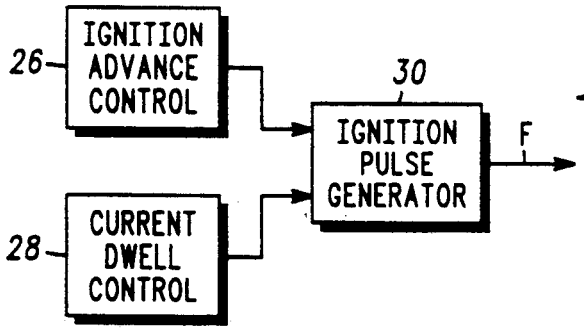
FIG. 5
FIG. 6
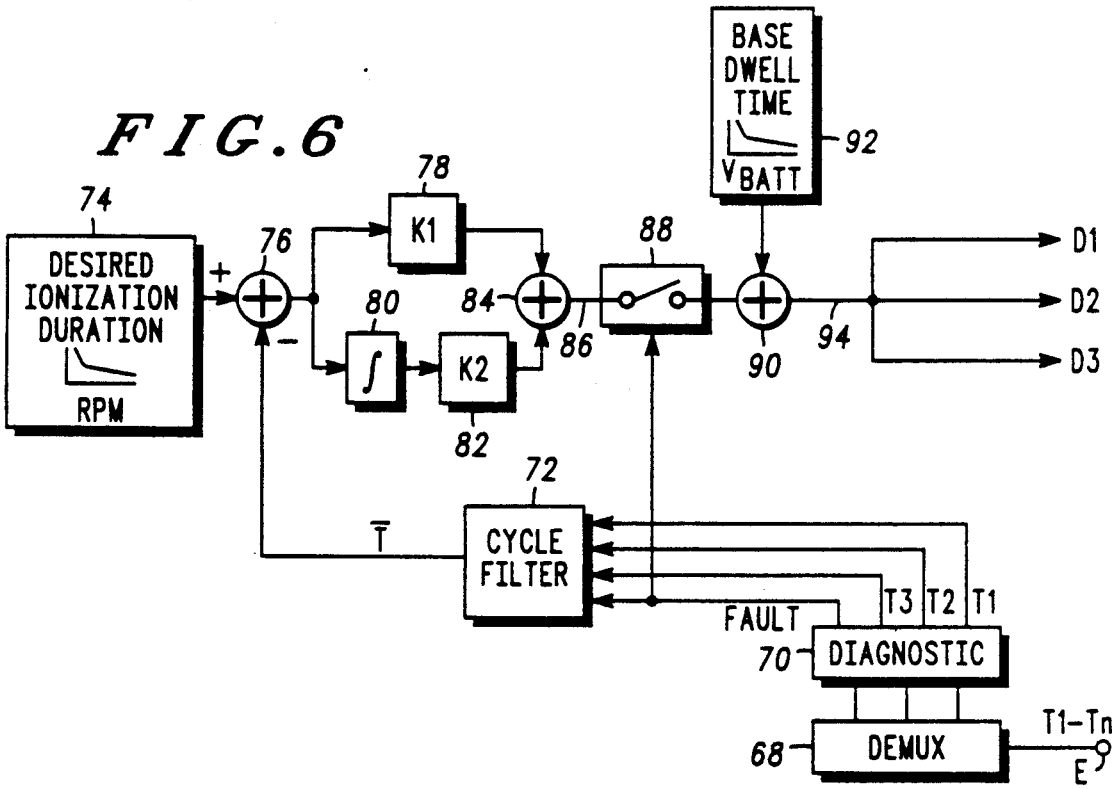

IONIZATION CONTROL FOR AUTOMOTIVE IGNITION SYSTEM

FIELD OF THE INVENTION

This invention is generally directed to automotive ignition systems, and particularly to techniques for controlling or optimizing the ionization time of spark plugs that are powered by the ignition system.

BACKGROUND OF THE INVENTION

A conventional automotive ignition system includes an ignition coil which powers a number of spark plugs so as to cause ionization between electrodes of each spark plug. The duration of ionization (referred to herein as "ionization time") is an important factor affecting engine efficiency, and it is usually desirable that the ionization time of each spark plug be substantially equal to the ionization time of every other spark plug in the engine, and also equal to a nominal ionization time.

A problem with conventional ignition systems is that they are usually insensitive to variables which can affect the ionization time of the spark plugs. For example, a change or error in the gap between a spark plug's electrodes can result in incorrect ionization time. Moreover, if the ionization time of one spark plug is greatly different from the ionization time of other spark plugs in the same engine, an imbalance occurs which reduces the efficiency of the engine. Changes in the characteristics of a conventional ignition coil can also result in improper ionization time for the spark plugs.

A related problem arises because such conventional systems operate with excess current dwell by saturating the ignition coil to ensure that the ignition system has enough energy to fire even fouled or mis-gapped spark plugs. This results in undesirably high power dissipation in the ignition coil, and particularly in the driver which supplies current to the ignition coil.

A further shortcoming of conventional ignition systems is their inability to detect, and alert the operator to, ignition system faults and/or spark plug faults which give rise to improper ionization times.

OBJECTS OF THE INVENTION

It is a general object of the invention to provide an improved method and apparatus for controlling the ionization times of spark plugs in an automotive ignition system.

It is a more specific object of the invention to provide such method and apparatus so as to reduce power dissipation, provide improved diagnostics, and optimize ionization time.

BRIEF DESCRIPTION OF THE DRAWINGS

FIGS. 4, A–F show various waveforms that are developed by the system shown in FIG. 1;

FIG. 5 is a functional block diagram illustrating in a broad sense how the electronic engine controller (FIG. 1) develops drive pulses that are used to control the current in the primary winding of the ignition coil;

FIG. 6 is a functional representation illustrating more specifically how the electronic engine controller may be programmed to develop drive pulses that control the dwell time of current in the ignition coil's primary winding;

DESCRIPTION OF THE PREFERRED EMBODIMENT

Figure 1:
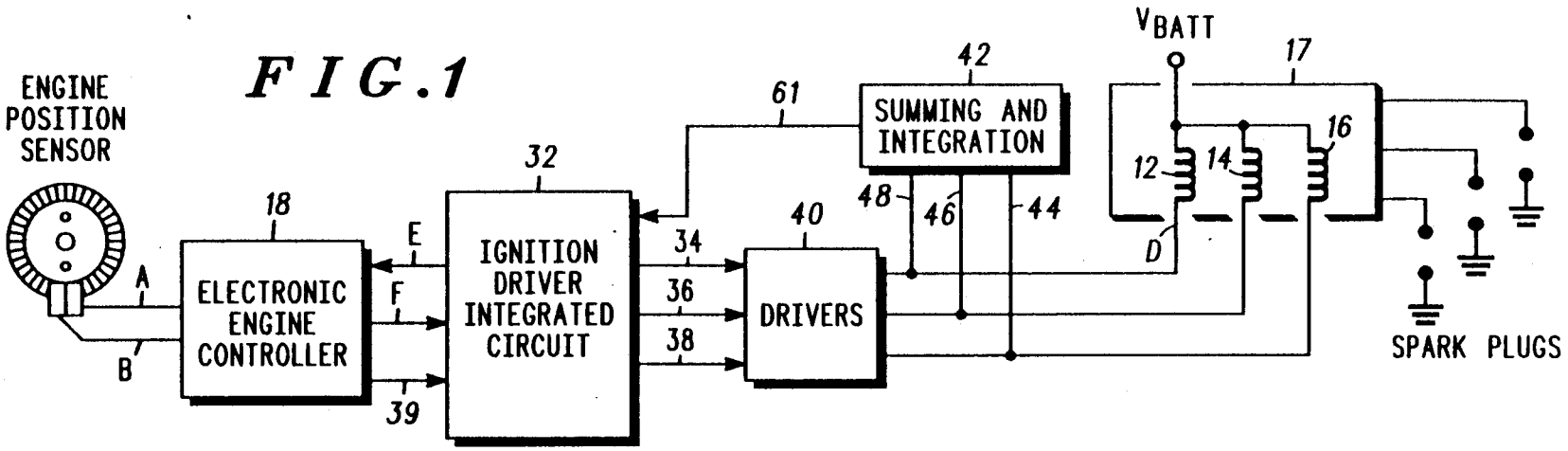
FIG. 1 is a block diagram of an exemplary engine control system that may be used to implement the invention.

Referring to FIG. 1, there is shown an automotive control system for an internal combustion engine. This particular system is designed for a three cylinder engine which uses three primary windings 12, 14, 16, each of which is part of an ignition coil 17 which powers three spark plugs. Although only the primary windings of the ignition coil are shown, it will be understood that the ignition coil will include a secondary winding coupled to each primary winding for driving one of the illustrated spark plugs. It should also be understood that, although this specification describes the invention in terms of an embodiment for a three cylinder, distributorless engine, the invention is useful with other engines having any number of cylinders, so long as the engine uses at least one ignition coil.

The heart of the system 10 is an electronic engine controller 18 which typically includes a microprocessor such as a MC68HCll made by Motorola, Inc. To some extent, the controller 18 is conventional in that it receives inputs on leads A and B from an engine position sensor 20 for controlling various aspects of engine operation, including spark timing. The sensor 20 is preferably of the optical type described in U.S. Pat. No. 4,941,445, assigned to the Assignee of this invention. Alternately, a conventional reluctance-type sensor may be used to generate on leads A or B signals that are indicative of the position of the engine's crankshaft.

Referring briefly to FIG. 4, waveforms A and B illustrate the signals that are present on leads A and B in FIG. 1. The same kind of notation is used to indicate the occurrence of the other waveforms shown in FIG. 4.

Referring again to FIG. 1, the controller 18 also receives via a lead E information relating to the duration of ionization of each spark plug. That information, plus the pulses received on leads A and B, is used to generate drive pulses I1, I2 and I3 (waveform F in FIG. 4) for energizing the ignition coil's primary windings 12, 14, 16.

More specifically, the controller 18 uses the information on leads A and B to determine the time at which each spark plug should fire, and the controller uses the information on lead E to calculate how long each plug should fire. The output of the controller as shown in FIG. 4, waveform F, is a series of drive pulses I1, I2 and I3. The pulse I1 has an edge 22 which indicates when current should begin in the primary winding 12, and another edge 24 that determines when the current through the primary winding 12 should terminate. At such termination, the magnetic field created in the ignition coil collapses, thereby generating a high voltage in the ignition coil's secondary winding (not shown) that initiates ionization of the gas between the electrodes of the spark plug for cylinder number 1. As is discussed more fully below, the controller 18 is programmed to change the point in time at which the edge 22 of the pulse I1 occurs, thereby to change the duration of current dwell in the primary winding 12 and to change the duration of ionization for the spark plug for cylinder number 1. Drive pulses I2 and I3 are similarly modified to control the duration of ionization of the spark plugs in cylinders 2 and 3.

The way in which the controller 18 generates the drive pulses on lead F can be explained broadly by reference to FIG. 5. As shown, the controller 18 includes a function referred to an ignition advance control, identified by the box 26. The purpose of this function is to handle spark advance by generating drive pulses (waveform F) whose edges 24 are controlled in response to the inputs on leads A and B, and based also on conventional ignition algorithms and possible inputs from other sensors. The start time of each pulse (e.g., edge 22) in waveform F is determined by the function 28 based on inputs received on lead E. Thus, the functional box 28 (preferably implemented in software) varies the duration of the pulses in waveform F so as to control current dwell time in the ignition coil's primary windings. The output from functional block 28 is shown as D(n), where n varies from 1 to 3 for a 3-cylinder engine. Thus, output D(1) is a signal representing the desired width of the pulse I1, D(2) is a signal representing the desired width of pulse I2, and D(3) is a signal representing the desired width of the pulse I3.

The ignition pulse generator function 30 combines the spark advance information from box 26 with the current dwell time information from box 28 to generate the drive pulses shown in waveform F. These pulses are applied to an ignition driver IC 32 (FIG. 1) which may separate them into three separate signals on leads 34, 36 and 38 under control of a synchronization signal carried by a lead 39. Alternately, the signal on lead F may be demuxed (de-multiplexed) within the controller 18. A conventional driver circuit 40 may be included to amplify the drive pulses I1, I2 and I3 as needed, and turn on three transistor drivers which essentially act as switches to couple the windings 12 14, and 16 to ground in synchronism with the pulses I1, I2 and I3 of waveform F.

Figure 2:
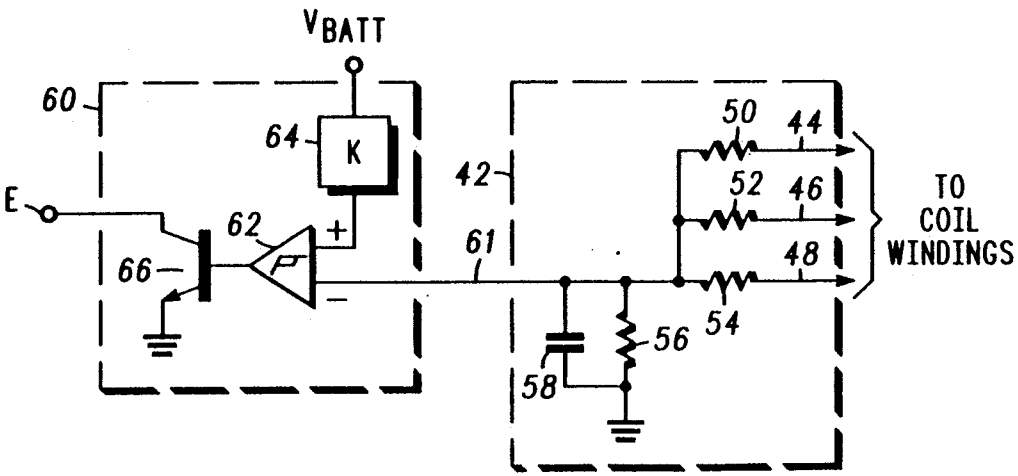
FIG. 2 is a more detailed schematic diagram of the ignition driver IC shown in FIG. 1.

The operation of the system depends significantly on knowing the ionization time (i.e., the duration of ionization) of each spark plug. To detect the ionization times of the spark plugs, the system of FIG. 1 includes a summing and integration network 42 that is coupled as shown to the coil windings 12, 14, and 16 via leads 44, 46 and 48. This network, shown in more detail in FIG. 2, includes a resistive network comprising resistors 50, 52 and 54 that are coupled to the windings 12, 14 and 16 to sense the voltage developed thereat so as to cooperate in generating a signal that is representative of the ionization times of the spark plugs.

Waveform C of FIG. 4 depicts the three currents that flow through the windings 12, 14, and 16 in response to the drive pulses of waveform F. Waveform D of FIG. 4 illustrates the voltage pulses generated in response to the termination of the current pulses of waveform C. The peak 60 indicates the start of ionization for the spark plug in cylinder 1 responsive to the termination of current in winding 12. The peaks 62 and 64 are likewise indicative of the start of ionization of the spark plugs in cylinders 2 and 3. The duration of each pulse in waveform D represents the duration of ionization for its associated spark plug.

Referring again to FIG. 2, the voltages sensed by resistors 50, 52 and 54 are applied to an integrator comprising a resistor 56 and a capacitor 58 which filters undesired high frequency components.

The output of the integrator is applied to a pulse shaper 60 via a lead 61. This shaper includes a comparator 62 with hysteresis having two inputs, one of which receives the output of the network 42, and the other of which receives a signal that is representative of battery voltage. The latter signal is developed by coupling battery voltage (VBAT) to a proportioning network 64 (such as a voltage divider) that applies a portion (K) of the battery voltage to the inverting input of the comparator. The value of the proportion K, and the amount of hysteresis in the comparator 62, are preferably selected such that the comparator's output changes state approximately at the levels L1 and L2 shown in FIG. 4 (waveform D). With this arrangement, the comparator 22 drives an output transistor 66 whose collector lead E carries the pulses shown as waveform E in FIG. 4. The width of pulse T1 in waveform E represents the ionization time (duration of ionization) of the spark plug for cylinder 1. Pulses T2 and T3 represent the ionization times of the spark plugs for cylinders 2 and 3, respectively. Hereinafter, the notation Tl–Tn represents the different ionization times for spark plugs associated with cylinders 1 through n, where n is the total number of cylinders.

Referring again to FIG. 1, the pulses Tl–Tn (waveform E) are coupled to an input of the controller 18 where they are used, along with the inputs received on leads A and B, to generate the drive pulses shown in waveform F. The widths of these drive pulses are controlled in accordance with a program stored in the controller 18 so as to control and/or optimize the ionization times Tl–Tn of the spark plugs. More specifically, the embodiments disclosed herein generally control the ionization times of the spark plugs by first measuring he actual ionization times (Tl–Tn) of the spark plugs. Next, a reference or target ionization time is provided, and this reference ionization time may be provided by a look-up table, or (as discussed in more detail below) calculated. The measured ionization times (Tl–Tn) and the reference ionization time are used to develop an error signal that is representative of any undesired deviation from the reference ionization time. The duration of the current dwell time in the primary windings of the ignition coil is then adjusted so as to change actual ionization time and reduce the size of the error signal.

Figure 3:
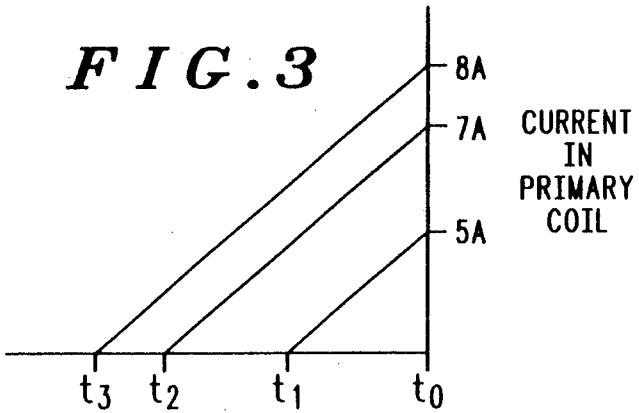
FIG. 3 is a graph showing various possible levels of current in the primary winding of an ignition coil, illustrating how the present invention shifts the starting time of such current.

The change in current dwell which the foregoing process provides is illustrated in FIG. 3, to which reference is now made. This graph shows various levels of current that are carried in a primary winding of the ignition coil as a function of different starting times for that current. For example, if the current is begun at time $t_1$, it ramps up to a level of 5 amps at time $t_o$ (time $t_o$ is determined by the trailing edge of a coil drive pulse (waveform F), such as edge 24 in FIG. 4). For this situation, therefore, the current dwell time is equal to the duration of the interval between $t_1$ and $t_o$. If the controller 18 modifies the width of a drive pulse by advancing the time at which edge 22 (waveform F) occurs, then the initiation of current through the primary winding would be moved from $t_1$ to $t_2$, thereby providing a larger current dwell time equal to the duration of the interval between $t_2$ and $t_o$. By thus increasing (or decreasing) the duration of current dwell time in the ignition coil's primary winding, the ionization time of the associated spark plug is increased (or reduced).

One of the advantageous aspects of the present system is that the currents in the primary windings increase continuously as shown in FIG. 3 until the time $t_o$ occurs, without leveling out prior to reaching $t_o$. In contrast, conventional ignition systems cause the current in the primary winding to ramp up to a limit level, and then the current is held substantially constant at that limit level until time $t_o$ is reached, but this conventional technique has the disadvantage of dissipating excessive power. The present technique of choosing an appropriate current starting time to give a desired ionization time without reaching and holding at a limit current level in the ignition coil is more desirable from the standpoint of dissipating less power. And it is made possible primarily by the fact that the ionization times are constantly being monitored to insure that the ignition coil has just the right amount of energy (controlled by varying the current dwell time) to provide the desired ionization time.

Referring now to FIG. 6, a functional block diagram is shown to generally illustrate one aspect of this invention. These functional blocks represent functions that are preferably implemented by the execution of a software program (to be discussed later) by the controller 18.

Signals representing the actual ionization times Tl–Tn (waveform E) are input to a functional box 68 (demux) which separates the train of pulses Tl–Tn into three separate signals T1, T2 and T3. These separated (demuxed) pulses are applied to an optional diagnostic function box 70 which serves to identify fault conditions that can be determined from the ionization times Tl–Tn.

The output of the function box 70 includes a fault signal plus the three ionization times T1, T2 and T3, all of which are applied to a cycle filter function box 72.

The purpose of the cycle filter is to develop an average ionization time $\overline{T}$ for at least selected ones of the N spark plugs. If no fault conditions are sensed, the value of $\overline{T}$ is developed by taking the average of all the ionization times Tl–Tn. If a fault condition is sensed, e.g., if the ionization time T3 for cylinder number 3 is abnormally long or short, the value of T3 may be disregarded in the calculation of $\overline{T}$.

A look-up table 74 is provided, preferably within the controller 18, to provide a desired ionization time (DIT). As shown, the desired ionization time (duration of ionization) is a function of engine RPM, so the controller 18 selects the DIT for the existing RPM of the engine. A summing function 76 receives the $\overline{T}$ signal and the DIT and finds the difference $\Delta$ T between the average ionization time $\overline{T}$ and the desired ionization time DIT. This difference $\Delta$ T constitutes an error signal whose value will be reduced in the present system by adjusting the duration of current dwell time for at least the selected spark plugs (i.e., the plugs having normal ionization times), thereby to adjust the ionization times of the selected spark plugs toward the DIT.

Adjustment of current dwell time preferably includes applying the difference $\Delta$ T to a conventional proportional integral control loop identified by the functional boxes 78, 80, 82 and 84. Box 78 multiples the signal $\Delta$ T by a factor K1 (which may have a value of about 0.05) and outputs the result to summing box 84. Box 80 integrates the signal $\Delta$ T, and box 82 multiplies the integrated signal by a factor K2 (which may have a value of about 0.0001). The output of the box 82 is applied to the summing box 84, the output of which on lead 86 constitutes a dwell correction signal. This dwell correction signal signifies the amount of dwell correction needed to start reducing the signal $\Delta$ T to zero. In the case where the average ionization time $\overline{T}$ is equal to the desired ionization time DIT, the dwell correction signal on lead 86 will be zero.

As shown, the dwell correction signal that is provided on lead 86 is applied to a switch function box 88 that is controlled by a fault signal developed by the diagnostic function box 70. In the case where the diagnostic function box 70 determines that an ionization time is abnormally long or short for a given cylinder, the resultant fault signal will open this switch function 88 when an error signal is being developed for the ionization time control for that cylinder. In all other cases, the switch will be closed in order to couple the dwell control signal on lead 86 to a summing function box 90.

The other input to the summing function box 90 is taken from a look-up table 92 which includes a table of base dwell times as a function of battery voltage. As illustrated in the box 92, base dwell times generally decrease as battery voltage increases. Further, the dwell times included in the look-up table 92 are dwell times which are intended to be used in the case where no dwell correction is required. The selected dwell time from the look-up table 92 is applied to the summing function box 90 along with the dwell correction signal from lead 86 to develop, on output lead 94, a coil drive signal which provides corrected current dwell times that are to be established in the primary windings of the ignition coil. These coil drive signals are shown as signals D1, D2 and D3, corresponding to corrected current dwell times for cylinders 1, 2 and 3. These signals D1, D2 and D3 are the same as the signals which appear at the output lead F (FIG. 1) from the engine controller 18.

According to the implementation shown in FIG. 6, a single output lead 94 carries all three signals D1, D2 and D3. Hence, at any given instant in time, D1=D2=D3, and all the primary windings 12, 14, 16 receive the same signal, carry substantially the same current, and have the same current dwell time which changes as the average dwell time $\overline{T}$ changes with respect to the desired ionization time provided by the look-up table 74. Thus, one may think of the currents in these primary windings as being controlled as a group, as opposed to being controlled individually and having different dwell times. The actual software program that is used to implement the functions depicted in FIG. 6 will now be described with reference to FIG. 9.

Figure 9:
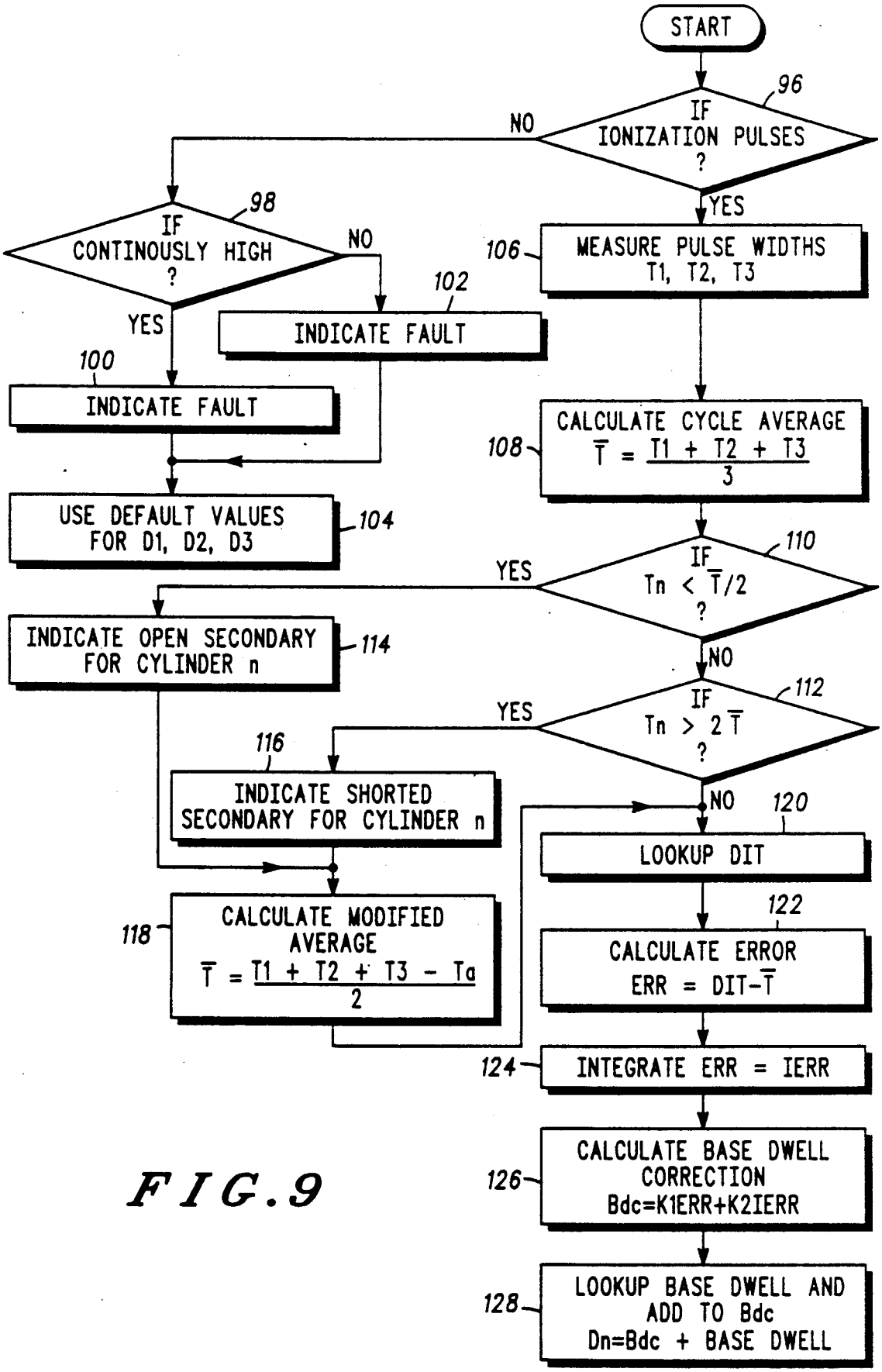
FIG. 9 is a flow chart illustrating how the electronic engine controller may be programmed to effect the functions depicted in FIG. 6.

The flow chart illustrated in FIG. 9 begins with an instruction 96 which is part of the diagnostic function shown in FIG. 6. This instruction inquires as to whether the pulses Tl–Tn (shown in waveform E) are present. If the answer to this inquiry is "no", then a fault situation exists and the program proceeds to instruction 98. Per this instruction, the program determines whether the signal carrying the pulses Tl–Tn is continuously high. If the answer to that question is "yes", then a particular type of fault is present and that fact is indicated per the next instruction 100. This may result in a fault indicator light, or other such device, being energized to alert the automobile operator to the fact that a fault has been found and that the fault is of the particular kind which results in the ionization signal being continuously high, such as the line which carries the fault signal being open.

If the ionization signal that was analyzed per instruction 98 did not show a continuously high state, then a continuously low condition is present and the program would proceed to instruction 102 which causes another fault indicator to be energized so as to identify this particular form of fault to the operator, such as a short to ground in the lead which carries the fault signal. After the execution of either instruction 100 or 102, the program proceeds to instruction 104 which causes the engine controller to select default values for the signals D1, D2 and D3 as shown in FIG. 6. These default values may be the values provided for the base dwell time from the look-up table 92, also shown in FIG. 6.

Returning to instruction 96, if the execution of that instruction determined that the ionization pulses were present, then the program would proceed to instruction 106 which instructs the engine controller to measure the width of each of the pulses T1, T2 and T3 (waveform E). The next instruction 108 causes the engine controller to calculate the average ionization time $\overline{T}$ by summing the individual ionization times and dividing by the number of cylinders, in this case three.

The next two instructions 110 and 112 are a part of the diagnostic function and they basically examine the duration of the pulses T1, T2 and T3 to determine whether they are abnormally long or abnormally short. Per instruction 110, the engine controller examines each pulse and compares it to one-half the value of the previously calculated average ionization time $\overline{T}$. If any one of those ionization times is less than one-half the value of $\overline{T}$, the program proceeds to instruction 114 which causes the controller to indicate that the ignition system has an open secondary for the cylinder having the abnormal ionization time. The instruction 112 determines whether any one of the pulses is greater than twice the value of the average ionization time $\overline{T}$. If any one of those pulses does exceed that value, then the program proceeds to instruction 116 to indicate that the ignition system has a shorted secondary associated with that particular cylinder. If either instruction 114 or 116 has been executed, the program moves to instruction 118 which causes the engine controller to calculate a modified value for the average ionization time $\overline{T}$. For this particular example where a three cylinder engine generates pulses representative of ionization times T1, T2, and T3, it can be seen from the equation shown in instruction 118 that the abnormal ionization time (designated as Ta) is subtracted from the sum of the ionization times, and that the resultant sum is divided by two rather than three.

Following instruction 118 (in the case of an abnormal ionization time having been identified), or after the execution of instruction 112 (in the case where no abnormal ionization time is detected), the program proceeds to instruction 120 which causes the engine controller to look up the desired ionization time DIT from the look-up table 74 shown in FIG. 6. Following that, instruction 122 calculates the error signal by subtracting the previously calculated value for the average ionization time $\overline{T}$ from the desired ionization time DIT.

The next two instructions, 124 and 126, implement the functions associated with a proportional integral control loop and its associated blocks 78, 80, 82 and 84 in FIG. 6. Per instruction 124, the error value calculated by instruction 122 is integrated to form a new signal IERR. The value for IERR may be calculated by summing $\Delta$ T with the value of IERR found during the previous pass through this program. Next, instruction 126 calculates a base dwell correction Bdc by multiplying the error signal ERR by the factor K1, multiplying the integrated error signal IERR by the factor K2, and summing both products. The base dwell correction factor thus calculated by instruction 126 corresponds to the dwell correction signal which is produced on the lead 86 in FIG. 6.

The next instruction 128 causes the engine controller to look up the base dwell time from the lookup table 92 and to add the base dwell correction factor Bdc to that base dwell time to arrive at the output drive signal Dn. In this case, since all three primary windings of the ignition coil receive the same drive signal to develop the same dwell time, Dn=D1=D2=D3. Comparing this to waveform F in FIG. 4, it should be understood that the value for the output drive signal that has been calculated pursuant to instruction 128 results in a drive pulse such as I1 shown in waveform F, and that the drive pulses I2 and I3 will have the same duration as the pulse I1 for this particular embodiment. On the next and subsequent passes through this program, the duration of all the pulses I1, I2 and I3 will be equally adjusted again until the value of the error signal has been reduced to near zero. For a step-error, the desired amount of reduction in the value of the error signal will typically require approximately six passes through the program shown in FIG. 9, depending on the value selected for K2 in instruction 126.

In the embodiment just described, the average ionization time $\overline{T}$ is made equal to, or nearly equal to, a desired or target ionization time by adjusting the current dwell times in the primary windings as a group. In another embodiment of the invention, the current dwell times developed in the three primary windings of the ignition coil are controlled separately rather than as a group, still for the purpose of controlling the ionization times of the spark plugs. This latter approach is shown graphically in FIG. 7 to which reference is now made.

Figure 7:
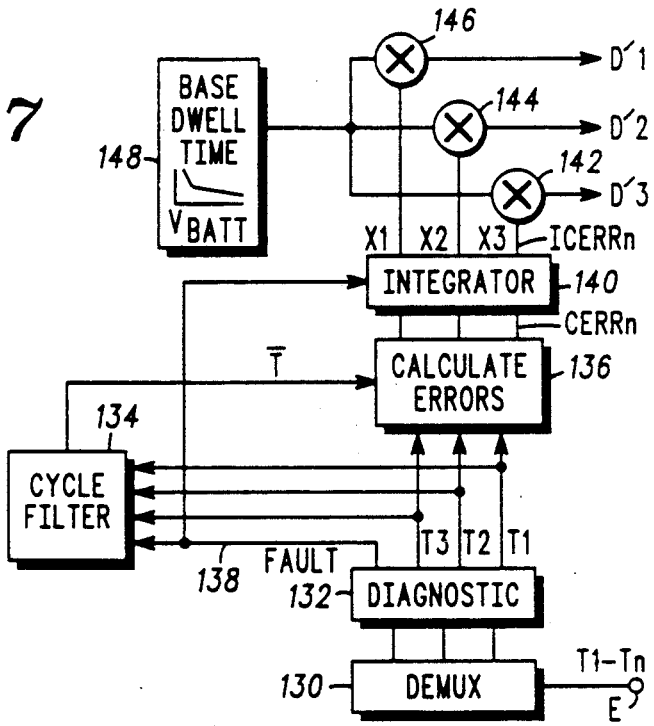
FIG. 7 is a functional representation illustrating another method by which the electronic engine controller may be programmed to develop drive pulses that result in a different type of control over the dwell time of current in the ignition coil's primary winding.

Like FIG. 6, FIG. 7 is a graphic representation of a software program which will be discussed subsequently. As shown, the input is the signal which carries the measured ionization times Tl–Tn. This signal is applied to the input of a demux function box 130, the output of which comprises three separate signals T1, T2 and T3, each of which represents the actual measured ionization time of one of the three spark plugs. A diagnostic function box 132, similar in function to the diagnostic function described in connection with the FIG. 6 embodiment, passes the ionization time signals T1, T2 and T3 on to a cycle filter function box 134 and to a function box 136 for calculating errors. Another output of the diagnostic function box 132 is a fault signal on a lead 138 which identifies whether or not a fault has been determined as result of examining the ionization times Tl–Tn.

The cycle filter 134, as with the previously discussed embodiment, generates a signal representing a signal $\overline{T}$ which represents the average ionization time of the signals Tl–Tn. In this embodiment, the average ionization time $\overline{T}$ is used as a reference ionization time.

The average ionization time $\overline{T}$ forms one input to the function box 136 which compares $\overline{T}$ to each of the three ionization times T1, T2 and T3, and calculates three error signals identified as CERRn, wherein CERR1 identifies an error associated with the ionization time T1, CERR2 identifies an ionization error associated with the ionization time T2, and CERR3 identifies an ionization error associated with the ionization time T3. These three errors, along with the fault indication signal on lead 138, are applied as inputs to an integrate function box 140 which integrates each of the errors developed by the error calculation function box 136. The three integrated error signals are also identified in FIG. 7 as X1, X2 and X3, constituting correction factors for adjusting the ionization times of the spark plugs for cylinders 1, 2 and 3 respectively.

The correction factors X1, X2 and X3 are selected to provide ionization times for each spark plug that are substantially equal to the average ionization time $\overline{T}$. These correction factors are applied, as shown, to multiplication function boxes 142, 144 and 146 which also receive from a look-up table 148 a signal representing a base dwell time. Multiplying the base dwell time by the correction factors Xl–Xn provides signal D'1, D'2 and D'3 which constitute corrected current dwell times for the primary windings 12, 14 and 16, respectively, of the ignition coil. These corrected current dwell times are used to generate the signal shown in waveform F of FIG. 4, but in this embodiment the durations of the resultant drive pulses are not necessarily equal to each other. That is, a different corrected dwell time is generated for each of the primary windings such that each corrected current dwell time results in an actual ionization time that, with each pass through the program, is closer to the average time $\overline{T}$.

Figure 10:
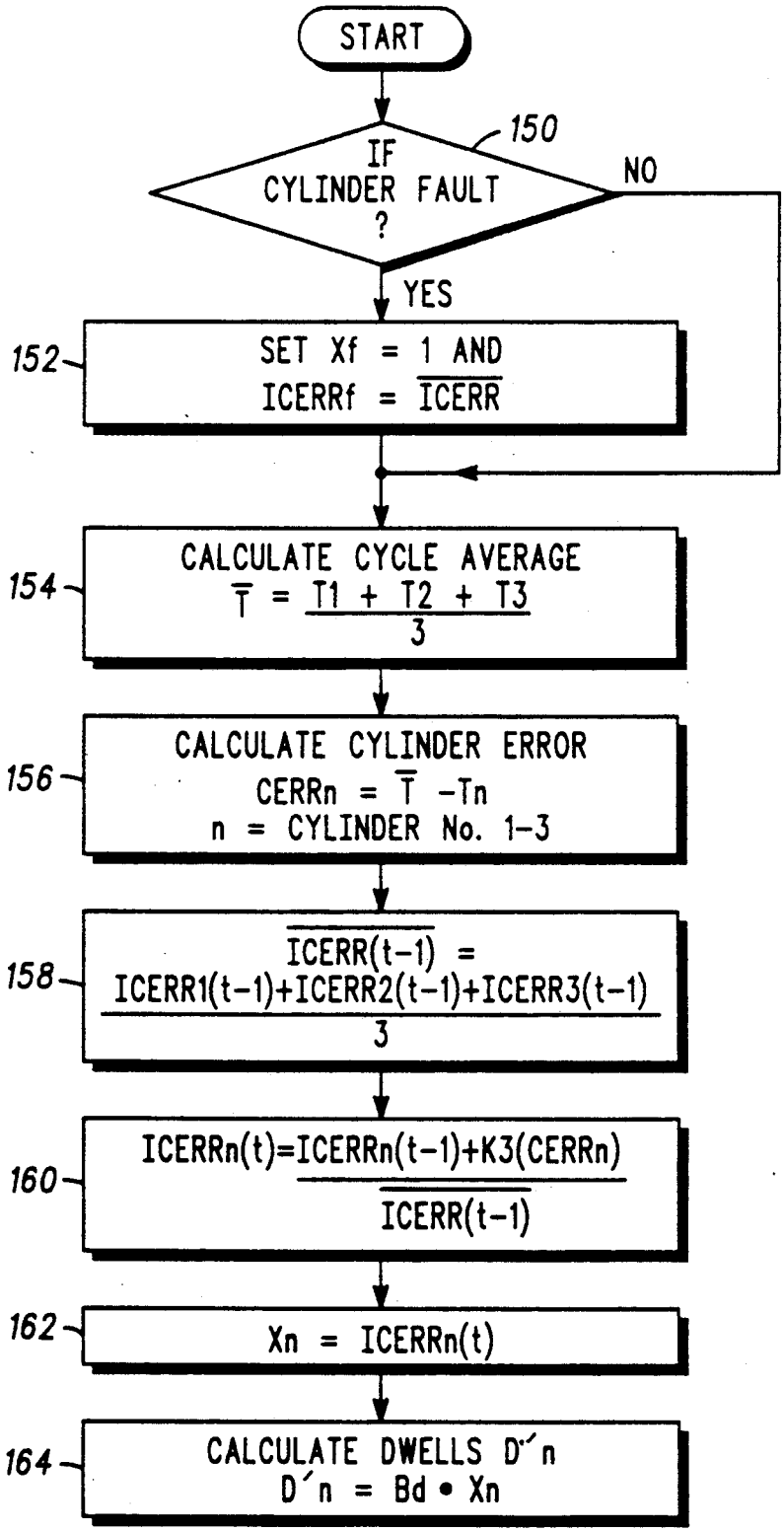
FIG. 10 is a flow chart illustrating how the electronic engine controller may be programmed to effect the functions depicted in FIG. 7.

The actual software program that is used to implement the functions depicted in FIG. 7 will now be described with reference to FIG. 10. This FIG. 10 depicts a flow chart which begins with an instruction 150 which determines if any of the ionization times Tl–Tn are abnormal, thereby to determine whether there is a fault associated with any of the cylinders. This instruction 150 essentially comprises the diagnostic functions indicated by program instructions 96, 98, 100, 102 and 104 of the flow chart shown in FIG. 9.

If as a result of executing the instruction 150 no faults are identified, then the program proceeds to the next instruction 154. On the other hand, the existence of a fault results in the program proceeding to instruction 152 which sets Xf=1, where Xf is the correction factor associated with TM TM a cylinder identified as having a fault. Another variable indicated as ICERRf is set equal to $\overline{ICERR}$, where the variable ICRRf is an integrated and normalized error signal for the cylinder associated with the identified fault.

After the execution of instruction 150 and/or 152, the program proceeds to instruction 154 which cause the average ionization time $\overline{T}$ to be calculated by summing the individual ionization times and dividing by the number of summed ionization times. The next instruction 156 calculates cylinder error CERRn where n varies from 1 to 3 for a 3 cylinder engine. As shown by the equation in instruction 156, the error for each cylinder is determined by subtracting from the average ionization time the value of the ionization time for the particular cylinder under consideration.

The program proceeds to instruction 158 which calculates an average integrated and normalized error signal, which actually constitutes an average correction factor for the previous cycle of operation, identified as $\overline{ICERR}$ (t−1); that signal is equal to the sum of the individual integrated and normalized error signals for each of the three spark plugs, as determined on the previous pass through this program, divided by the number of spark plugs. The next instruction 160 calculates the integrated and normalized value of the error signal for each of the spark plugs for the present time; thus, the variable ICERRn(t) identifies the integrated and normalized value of the error signal for an individual spark plug n (where n varies from 1 to 3) at the present time (t). This value becomes the previous value ICERRn (t−1) that is used in the next pass through this program in instruction 158. As shown by the equation in instruction 160, the numerator of the illustrated equation is equal to the integral of an error signal CERRn for spark plug n, which numerator includes the value ICERRn (t−1) calculated for the same spark plug during the last pass through this program, plus K3 times the value of the error signal developed by instruction 156 for that same spark plug. The denominator of this equation is the average correction factor $\overline{ICERR}$ (t−1), calculated by previous instruction 158.

The value selected for the factor K3 determines how quickly the program adjusts the values of the dwell times to reach the desired ionization time. In a typical case, the value of K3 may be set to 0.0001. In the case of a step-error, this value will cause the program to substantially complete the correction to all the ionization times after about six passes through the program.

The next instruction 162 merely simplifies the notation used herein by stating that the variable whose value was found in the previous instruction 160 is identified as Xn, where Xn identifies the three correction factors X1, X2 and X3. Having now found those correction factors, the next instruction 164 calculates the corrected dwell times D'n by multiplying the base dwell time Bd (as received from the look-up table 48 in FIG. 7) times the correction factor for the appropriate cylinder. These corrected dwell times are the same as those shown in FIG. 7 and identified therein as D'1, D'2 and D'3, all of which are used by the electronic engine controller 18 in FIG. 1 to develop drive pulses (waveform F) that result in corrected dwell times for each of the primary windings 12, 14 and 16 of the ignition coil. As previously stated, the dwell times for each of the primary windings will, for the particular embodiment that is reflected by the flow chart of FIG. 10, be different, i.e. customized, to account for system variations that result in somewhat different ionization characteristics for the different cylinders. This is achieved essentially by measuring the actual ionization time for each spark plug, comparing each of the ionization times to the average ionization time, which in this embodiment, is used as reference, and then calculating a correction factor for each of the ignition coil primary windings to customize the dwell time of each such winding to provide an actual ionization time for each of the individual spark plugs that is substantially equal to the average ionization time $\overline{T}$. This provides better engine balance by causing the fuel to be more uniformly ignited.

It will be recalled that the embodiment represented by FIGS. 6 and 9 achieved improved ignition of fuel by using a common dwell time for each spark plug, but adjusting the common dwell time until the average ionization time $\overline{T}$ equalled a desired ionization time (DIT) provided by a look-up table. In contrast, the embodiment represented by in FIGS. 7 and 10 gives a similar result by a different process that individually adjusts the dwell time associated with each spark plug so that the actual ionization time of each spark plug is made equal to the average ionization time $\overline{T}$, without reference to a desired ionization time as might be provided by a look-up table. This latter technique is particularly useful with lean burning engines, such as a two-stroke or four-stroke engine with a stratified charge ignition system.

To illustrate how the embodiment of FIGS. 7 and 10 can control ionization times, Tables 1 and 2 below are provided. They are based on a value of K3 equal to 0.0001.

TABLE 1

| Cycle | T1 | T2 | T3 | $\overline{T}$ |
|---|---|---|---|---|
| 0 | 1800 | 2000 | 2200 | |
| 1 | 1800 | 2000 | 2200 | 2000 |
| 2 | 1830 | 2000 | 2170 | 2000 |
| 3 | 1860 | 2000 | 2140 | 2000 |

TABLE 2

| Cycle | X1 | X2 | X3 | D'1 | D'2 | D'3 |
|---|---|---|---|---|---|---|
| 0 | 1.0 | 1.0 | 1.0 | 3500 | 3500 | 3500 |
| 1 | 1.02 | 1.0 | .93 | 3570 | 3500 | 3430 |
| 2 | 1.037 | 1.0 | .963 | 3605 | 3500 | 3370 |
| 3 | 1.05 | 1.0 | .949 | 3675 | 3500 | 3321 |

The values shown in Tables 1 and 2 show the results of calculations that occur on three passes (cycles) through the program shown in FIG. 10. They also assume that the look-up table 148 (FIG. 7) provides a base dwell time of 3500 microseconds. All times are shown in microseconds.

Note that spark plug number 2 happens to have an ionization time T2 that is equal to the average ionization time $\overline{T}$. Hence, no correction is applied to the current dwell time of its primary winding. Its correction factor X2 remains at 1.0 and its current dwell time D'2 remains at 3500.

On the other hand, the ionization time T1 of spark plug number 1 is lower than $\overline{T}$, while the ionization time T3 of spark plug number 3 is higher than $\overline{T}$. Note how the correction factor X1 gradually increases in value for each cycle through the program and the value for the correction factor X3 is gradually reduced. After three cycles, the ionization time T1 has increased to 1860, the ionization time T3 has been reduced to 2140, and the ionization T2 remains at 2000.

Even more useful than the techniques described above with reference to FIGS. 6 and 7 is a combination of the two techniques that provides the benefits of both, i.e., control of individual dwell times, and the use of a desired ionization time (DIT) (as might be provided by a look-up table) to cause the actual ionization time of each spark plug to equal the desired ionization time. Such a combined technique is used in the embodiment shown in FIG. 8.

Figure 8:
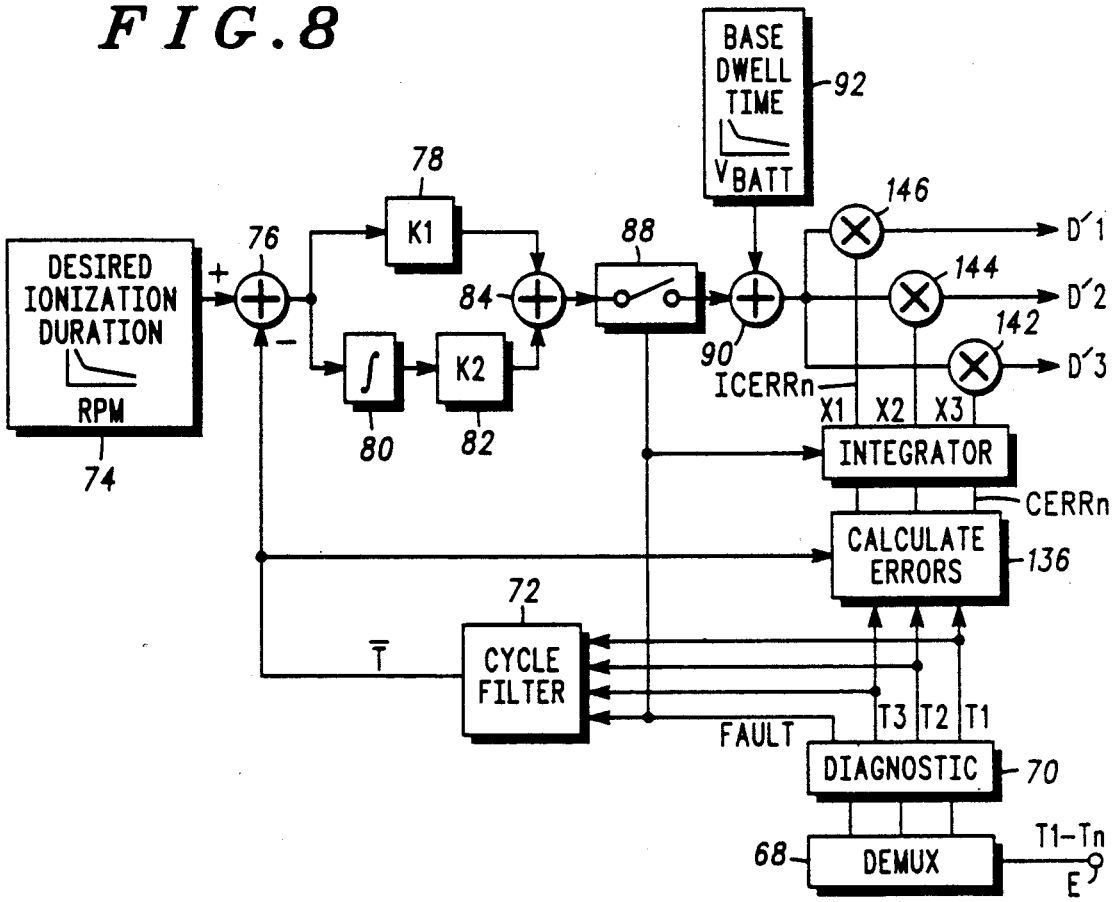
FIG. 8 is a functional representation of how the techniques shown in FIGS. 6 and 7 may be combined in programming the electronic engine controller.

Referring to FIG. 8, the illustrated technique is essentially a combination of the techniques shown in FIGS. 6 and 7. The function boxes of FIG. 8 which serve the same function as corresponding boxes in FIGS. 6 and 7 have been given the same reference numerals as their counterparts in those FIGS. In this illustrated embodiment, the input is the signal which represents the ionization times Tl–Tn of all of the spark plugs. This input signal is demuxed per function box 68 and fed to the diagnostic box 70 which operates as previously described in connection with FIG. 6.

The outputs of the diagnostic box 70, the individual ionization times T1, T2 and T3, are sent to the cycle filter 72 which develops a signal representing the average ionization time $\overline{T}$. That signal is applied to the summing box 76 as well as to the error calculation box 136. The other input to the summing box 76 is the desired ionization time from the look-up table 74. The difference between these inputs constitutes the error signal that is applied to the illustrated proportional control loop whose output on lead 86 constitutes a dwell correction signal. The function of the box 88, and the way in which the fault indication signal operates, is identical to the corresponding function box as described with respect to FIG. 6.

To calculate correction factors X1, X2, and X3, the individual ionization times are applied to the function box 136 which calculates the error signals as already described. The output of that box 136 is applied to an integrate function box 140, the output of which comprises the correction factors X1, X2 and X3.

The signal which these correction factors are multiplied against is received from the output of the summing box 90, which output is referred to herein as an "intermediate" corrected dwell time signal because it is corrected only insofar as it comprises base dwell time information from look-up table 92 that has been modified to adjust the common dwell time associated with all the spark plugs so that their average ionization time is equal to the desired ionization time. By multiplying the output of the function box 90 by the correction factors X1, X2 and X3, fully corrected dwell time signals D'1, D'2 and D'3 are provided to individually control the dwell time associated with each of the spark plugs so as to make the ionization time of each spark plug equal to the desired ionization time provided by the look-up table 74. With this arrangement, a great deal of compensation is provided for fouled spark plugs and other variables which tend to result in non-optimal ionization times. By controlling the dwell time in each individual primary winding differently, as needed, the ionization time of each spark plug can be made equal to, or substantially equal to, the desired ionization time. This provides a well-balanced engine whose fuel is uniformly burned. A software program which can implement the techniques depicted in FIG. 8 is essentially a combination of the instructions shown in the flow charts of FIGS. 9 and 10.

It should be apparent from the foregoing description that the present invention has a number of advantages, including eliminating power dissipation that results from excess current dwell in the ignition coil, and providing balanced, equalized spark energy. Further, significantly more diagnostic information is available, and the need to monitor and/or control spark plug gap is greatly reduced, if not eliminated.

Although the invention has been described in terms of a preferred embodiment, it will be obvious to those skilled in the art that many alterations and variations may be made without departing from the invention. Accordingly, it is intended that all such alterations and modifications be considered as within the spirit and scope of the invention as defined by the appended claims.

What is claimed:

1. In an internal combustion engine having N spark plugs having ionization times that are controllable by the duration of current dwell in at least one ignition coil, a method of controlling the ionization time of the spark plugs, comprising:

(a) measuring the ionization times (Tl–Tn) of the spark plugs;

(b) providing a reference ionization time;

(c) using the measured ionization times and the reference ionization time to develop an error signal that is representative of an undesired deviation from the reference ionization time; and (d) adjusting the duration of the current dwell time in the ignition coil so as to change ionization time and reduce the size of the error signal.

2. A method as set forth in claim 1 wherein the reference ionization time is provided by a table of desired ionization times, and wherein step (c) includes:

using the measured ionization times (Tl–Tn) to develop an average ionization time ($\overline{T}$); and comparing the average ionization time ($\overline{T}$) to the reference ionization time to develop the error signal.

3. A method as set forth in claim 2 wherein step (d) includes providing a corrected dwell time signal for adjusting the duration of current dwell, and using the same corrected dwell time signal to control the ionization times of all the spark plugs.

4. A method as set forth in claim 1 wherein step (b) includes using the measured ionization times (Tl–Tn) to develop an average ionization time ($\overline{T}$), and using the average ionization time ($\overline{T}$) as the reference ionization time.

5. A method as set forth in claim 4 wherein an error signal is developed for each spark plug, wherein each error signal is a function of the difference between the average ionization time ($\overline{T}$) and a measured ionization time, and wherein each error signal is used to adjust the current dwell time, and hence, the ionization time, of its associated spark plug.

6. A method as set forth in claim 5 wherein each error signal is developed so that the resulting adjusted current dwell time provides an ionization time that is substantially equal to the average ionization time ($\overline{T}$).

7. A method as set forth in claim 1, further including indicating that a fault condition exists when one of the measured ionization times (Tl–Tn) is abnormally long or short.

8. In an internal combustion engine having N spark plugs having ionization times that are controllable by the duration of current dwell in at least one ignition coil, a method of controlling the ionization times of the spark plugs in accordance with a desired ionization time, comprising:

(a) measuring the ionization times (Tl–Tn) of the spark plugs;

(b) using the measured ionization times (Tl–Tn) to develop an average ionization time ($\overline{T}$) for at least selected ones of the N spark plugs;

(c) finding the difference ($\Delta$ T) between the average ionization time ($\overline{T}$) and the desired ionization time; and (d) adjusting the duration of current dwell time for at least the selected spark plugs so as to reduce the difference ($\Delta$ T) measured in step (c), thereby adjusting the ionization times of the selected spark plugs.

9. A method as set forth in claim 8 wherein the coil has a base current dwell time and wherein step (d) includes:

applying the difference ($\Delta$ T) to a proportional integral control loop to develop a dwell correction time, and combining the dwell correction time with the base current dwell time to provide a corrected current dwell time for at least the selected spark plugs.

10. A method as set forth in claim 9 further including using the measured ionization times (Tl–Tn) to develop correction factors (Xl–Xn) that are selected to provide ionization times for each spark plug that are substantially equal to the average ionization time ($\overline{T}$); and multiplying the corrected current dwell time by the correction factors to develop fully corrected current dwell times.

11. A method as set forth in claim 8, further including indicating that a fault condition exists when a measured ionization time is abnormally long or short.

12. A method as set forth in claim 11 further including identifying the spark plug associated with the abnormal ionization time, and deleting the abnormal ionization time from the calculation of the average ionization time ($\overline{T}$).

13. In an internal combustion engine having N spark plugs having ionization times that are controllable by the duration of current dwell in at least one ignition coil, a method of controlling the ionization time for each spark plug, comprising:

(a) providing a base current dwell time;

(b) measuring the ionization times (Tl–Tn) of the spark plugs;

(c) calculating an average ionization time ($\overline{T}$) based on the measured ionization times (Tl–Tn);

(d) using the measured ionization times (Tl–Tn) and the average ionization time ($\overline{T}$) to develop an error signal for each spark plug, each such error signal representing an ionization time error;

(e) using the error signals to calculate correction factors (Xl–Xn), one such factor associated with each spark plug, which, when combined with the base current dwell time, provides corrected current dwell times for the spark plugs such that the corrected current dwell times reduce the difference between the ionization times (Tl–Tn) and the average ionization time ($\overline{T}$); and (f) combining the base current dwell time with the correction factors (Xl–Xn) to provide corrected current dwell times.

14. A method as set forth in claim 13, further including indicating that a fault condition exists when one of the measured ionization times (Tl–Tn) is abnormally long or short.

15. A method as set forth in claim 13, including calculating a new correction factor for a given spark plug by:

1) calculating an average of the previously calculated correction factors for all the spark plugs;

2) calculating the integral of the error signal for the given spark plug; and 3) dividing the integral calculated in step 2 by the average calculated in step 1.

16. In an internal combustion engine having N spark plugs having ionization times that are controllable by the duration of current dwell in at least one ignition coil, a method of maintaining a desired ionization time for the spark plugs, comprising:

(a) measuring the ionization times (Tl–Tn) of the spark plugs;
(b) using the measured ionization times (Tl–Tn) to calculate an average ionization time ($\overline{T}$) for the spark plugs;
(c) finding a difference ($\Delta$ T) between the average ionization time ($\overline{T}$) and the desired ionization time;
(d) developing an intermediate corrected current dwell time based on the difference ($\Delta$ T),
(e) using the measured actual ionization times (Tl–Tn) to develop correction factors (Xl–Xn) that are selected to substantially equalize the ionization times of the spark plugs; and
(f) combining the intermediate corrected current dwell time with the correction factors to develop fully corrected current dwell times.

17. A method as set forth in claim 16, further including indicating that a fault condition exists when a measured ionization time is abnormally high or low.

18. A method as set forth in claim 16 further including:
sensing when a measured ionization time is abnormally high or low; and
deleting the abnormal ionization time is the calculation of the average ionization time ($\overline{T}$).

19. A method as set forth in claim 16, including calculating a new correction factor for a given spark plug by:
1) calculating an average of the previously calculated correction factors for all the spark plugs;
2) calculating the integral of the error signal for the given spark plug; and
3) dividing the integral calculated in step 2 by the average calculated in step 1.

20. For an internal combustion engine in which N spark plugs have ionization times that are controllable by the duration of current dwell in at least one ignition coil, a system for controlling the ionization times (Tl–Tn) of the spark plugs in accordance with a desired ionization time, comprising:
means for measuring the actual ionization times (Tl–Tn) of the spark plugs;
a programmable electronic engine controller that is programmed to:
a) provide a reference ionization time;
b) use the measured ionization times (Tl–Tn) and the reference ionization time to develop an error signal that is representative of an undesired derivation from the reference ionization time;
c) generate a coil drive signal which modifies current dwell time so as to reduce the error signal; and
a driver responsive to the coil drive signal and being coupled to the ignition coil so as to establish, in the ignition coil, current dwell times that are in accordance with the coil drive signal.

21. A system as set forth in claim 20, including a table of desired ionization times from which the reference ionization time is selected, wherein the error signal is developed by using the measured ionization times (Tl–Tn) to develop an average ionization time ($\overline{T}$), and comparing the average ionization time ($\overline{T}$) to the reference ionization time, and wherein the same coil drive signal is used to provide the same current dwell time for each spark plug.

22. A method as set forth in claim 20 wherein the reference ionization time is provided by using the measured ionization times (Tl–Tn) to develop an average ionization time ($\overline{T}$) which constitutes the reference ionization time, wherein a different error signal is developed for each spark plug by subtracting each measured ionization time from the average ionization time ($\overline{T}$), and wherein each error signal is developed so that the resulting adjusted current dwell time provides an ionization time that is substantially equal to the average ionization time.

23. In an internal combustion engine having N spark plugs having ionization times that are controllable by the duration of current dwell in at least one ignition coil, a system for controlling the ionization times (Tl–Tn) of the spark plugs in accordance with a desired ionization time, comprising:
means for measuring the ionization times (Tl–Tn) of the spark plugs;
a programmable electronic engine controller that is programmed to:
a) use the measured ionization times (Tl–Tn) to calculate an average ionization time ($\overline{T}$) for at least selected ones of the N spark plugs;
b) calculate the difference ($\Delta$ T) between the average ionization time ($\overline{T}$) and the desired ionization time;
c) calculate modified current dwell times for at least each of the selected spark plugs such that the modified current dwell times result in spark plug ionization times that reduce the difference ($\Delta$ T); and
d) generate a coil drive signal representative of the modified current dwell times; and
a driver responsive to the coil drive signal and being coupled to the ignition coil so as to establish, in the ignition coil, current dwell times that are in accordance with the coil drive signal.

24. A system as set forth in claim 23 wherein the ignition coil includes at least one a primary winding that receives current supplied by the driver, and wherein the means for measuring the ionization times (Tl–Tn) includes:
a resistive network coupled to the primary winding of the ignition coil for sensing the current therein and providing an output signal that is representative of the current; and
circuitry receiving the output signal for converting it to a series of pulses, the width of each pulse being representative of the ionization time of a spark plug.

25. A system as set forth in claim 24 wherein the ignition coil's primary winding is coupled to a battery voltage, and wherein the circuitry includes a comparator having two inputs, one input receiving the output signal from the resistive network and the other input receiving a signal representative of the battery voltage.

26. In an internal combustion engine having N spark plugs having ionization times that are controllable by the duration of current dwell in at least one ignition coil, a system for controlling the ionization times of the spark plugs in accordance with a desired ionization time, comprising:
means for measuring the ionization times (Tl–Tn) of the spark plugs;
means providing a base current dwell time;
a programmable electronic engine controller that is programmed to:
(a) calculate an average ionization time ($\overline{T}$) based on the actual measured ionization times;
(b) use the measured ionization times (Tl–Tn) and the average ionization ($\overline{T}$) to develop an error signal for each spark plug, each such error signal representing an ionization time error;

(c) for each spark plug, use its error signal to calculate a correction factor which, when combined with the base current dwell time, provides a corrected current dwell time for each spark plug such that the corrected current dwell times reduce the difference between the actual ionization times and the average ionization time ($\overline{T}$); and (d) combine the base current dwell time with the correction factors to provide a coil drive signal for correcting current dwell times; and a driver responsive to the coil drive signal and being coupled to the ignition coil so as to establish, in the ignition coil, current dwell times that are in accordance with the coil drive signal.

27. In an internal combustion engine having N spark plugs having ionization times (Tl–Tn) that are controllable by the duration of current dwell in at least one ignition coil, a system for controlling the ionization times of the spark plugs in accordance with a desired ionization time, comprising:

means for measuring the ionization times (Tl–Tn) of the spark plugs, a programmable electronic engine controller that is programmed to:

(a) use the measured ionization times (Tl–Tn) to calculate an average ionization time ($\overline{T}$) for the spark plugs;

(b) find the difference ($\Delta$ T) between the average ionization time ($\overline{T}$) and the desired ionization time;

(c) develop an intermediate corrected current dwell time based on the difference ($\Delta$ T);

(d) use the measured actual ionization times (Tl–Tn) to develop correction factors (Xl–Xn) that are selected to substantially equalize the actual ionization times of the spark plugs; and (e) combine the intermediate corrected current dwell time with the correction factors to develop a coil drive signal that is representative of fully corrected current dwell times; and a driver responsive to the coil drive signal and being coupled to the ignition coil so as to establish, in the ignition coil, current dwell times that are in accordance with the coil drive signal.

* * * * *